United States Patent [19]

Uthoff et al.

[11] 4,128,116

[45] Dec. 5, 1978

[54] METHOD AND APPARATUS FOR OPENING AND STACKING BAGS

[75] Inventors: Werner Uthoff, Beckum; Olaf Kluepfel, Ahlen-Vorheim, both of Fed. Rep. of Germany

[73] Assignee: Haver & Boecker Drahtweberei und Maschinenfabrik, Westfalen, Fed. Rep. of Germany

[21] Appl. No.: 827,016

[22] Filed: Aug. 23, 1977

[30] Foreign Application Priority Data

Aug. 26, 1976 [DE] Fed. Rep. of Germany ..... 2638415
Aug. 4, 1977 [DE] Fed. Rep. of Germany ..... 2735126

[51] Int. Cl.[2] ..... B65B 1/04

[52] U.S. Cl. ..... 141/1; 141/10; 141/68; 141/114; 141/166; 141/171; 53/573

[58] Field of Search ..... 53/187, 190, 29; 141/67, 68, 10, 114, 313–317, 1–9, 11, 12, 166, 171

[56] References Cited

U.S. PATENT DOCUMENTS

| | | | |
|---|---|---|---|
| 3,579,957 | 5/1971 | Mills et al. | 53/190 |
| 3,619,981 | 11/1971 | Burke et al. | 53/190 |
| 3,715,858 | 2/1973 | Durant et al. | 141/68 |
| 3,830,038 | 8/1974 | Prodst | 53/190 |
| 3,884,278 | 5/1975 | Nakashima | 141/114 |
| 3,949,536 | 4/1976 | Chevalier | 141/114 |
| 4,030,528 | 6/1977 | Horning | 141/114 |

*Primary Examiner*—Houston S. Bell
*Attorney, Agent, or Firm*—Spencer & Kaye

[57] ABSTRACT

A process for opening the valves of valved bags and for inserting the opened bags on spigots to fill the bags with bulk material, comprises the following steps: consecutively advancing the bags in a substantially horizontal plane towards the spigots, while the bag valve is oriented in the advancing direction of the bags and guiding each bag by a free edge of the bag top; pivoting, during the advancing step, the top of each bag about a top fold line from a horizontal orientation, in which it is substantially coplanar with the bag body, into a predetermined inclined position; pivoting, subsequent to the preceding pivoting step, that half of the bag top which is oriented towards the bag body, about the top fold line, into a predetermined inclined position with respect to the bag body, whereby the bag top assumes an inverted V configuration; pivoting, subsequent to the preceding pivoting step, the bag body downwardly into a vertical orientation; raising, subsequent to the preceding pivoting step, at least the valve-containing portion of the bag relative to the bag body for opening the valve while holding the bag body; and inserting, subsequent to the raising step, the bag on the respective spigot.

36 Claims, 14 Drawing Figures

FIG. 1
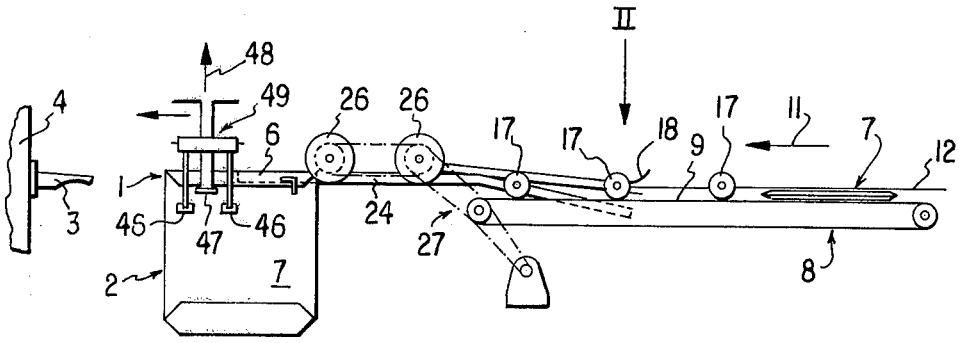
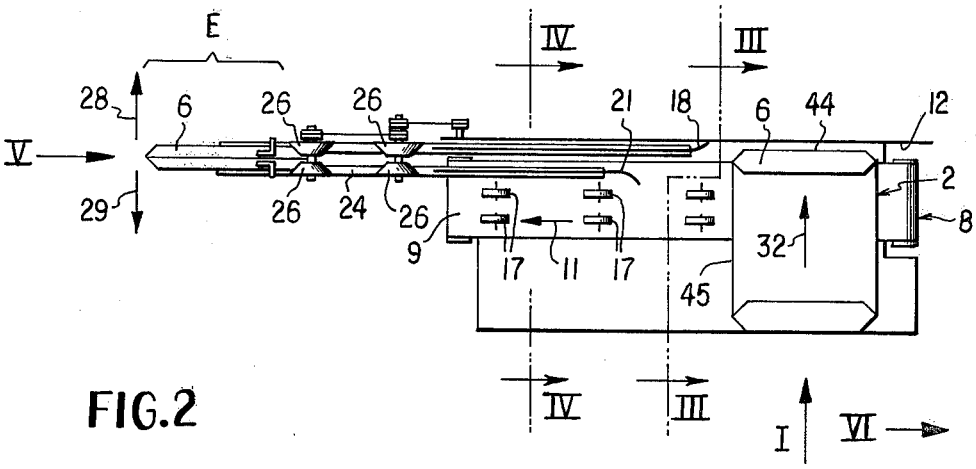
FIG.2
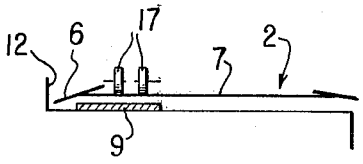
FIG. 3
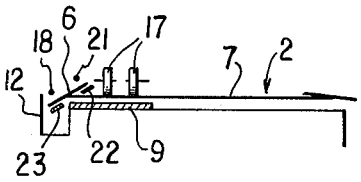
FIG. 4
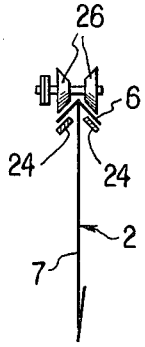
FIG.5

FIG. 6
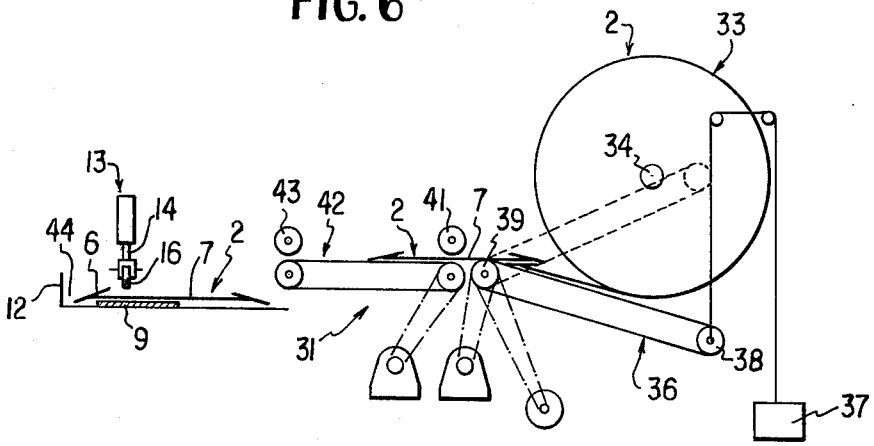
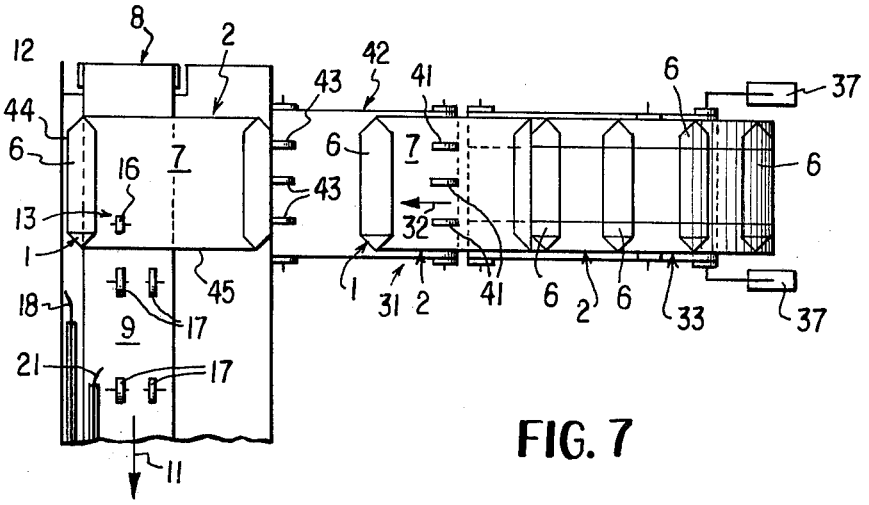
FIG. 7
FIG. 8
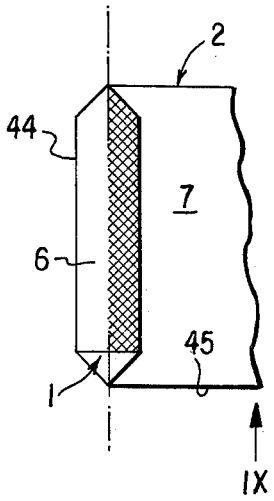
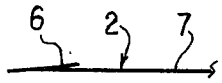
FIG. 9
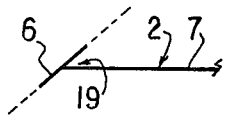
FIG. 10
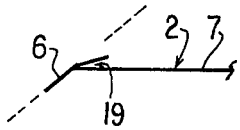
FIG. 11

FIG. 12
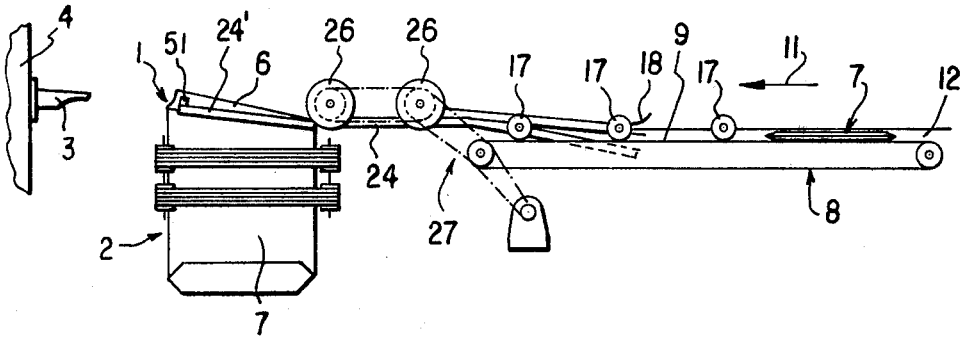
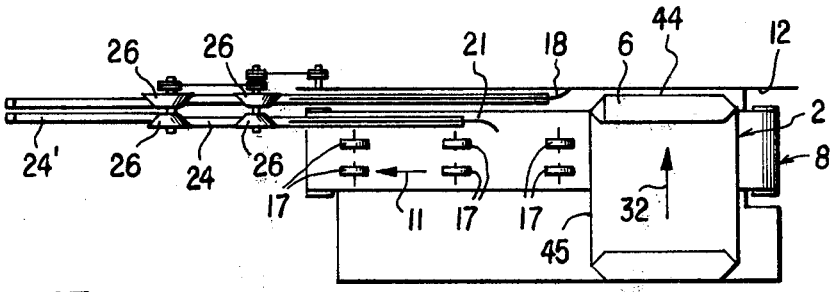
FIG. 13
FIG. 14
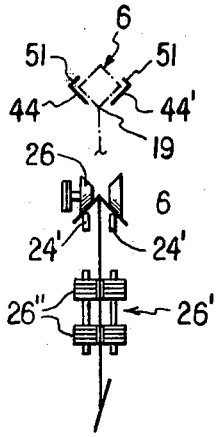

METHOD AND APPARATUS FOR OPENING AND STACKING BAGS

BACKGROUND OF THE INVENTION

The invention relates to a process for opening the valves of valved bags to be filled with a bulk material, more particularly cement, and for engaging (inserting) the opened bags on a filling spigot.

The invention also relates to an apparatus for opening the valves of valved bags to be filled with a bulk material, more particularly cement, and for engaging the opened bags on a filling spigot of the machine. The apparatus comprises pivoting means for pivoting the valve-containing portion of the respective bag top into a position in which it is substantially perpendicular to the plane of the bag body. The apparatus has transfer means for transferring the bags to the filling spigot and, after the valve has been opened by appropriate means, for engaging the bags on the filling spigot.

The usual current way of packing fine-grained bulk material, such as cement, is by means of filling machines which usually have a number of filling spigots for introducing the material into a bag.

The bags usually used are valved bags made of a strong paper. The advantage of such bags is that they close automatically as filling proceeds, so that no special measures are needed to seal the bags at their top.

A valved bag of the above type comprises a top which, with the bag filled, forms the top end surface of the bag, a body forming the bag walls, a bottom which is at the other end of the body and which, with the bag filled, forms the bottom end surface of the bag.

Except for the valve at the top, which will be described hereinafter, the bag top and bottom are of very similar construction, both being substantially rectangular and both being formed at both their ends as an equilateral triangle whose base corresponds to the length of the narrow side of the rectangle, the apex of the triangle being disposed centrally of the longitudinal line of symmetry of the top or bottom directly at the bottom or top end point of the lateral fold of the bag body.

The main difference between the bag top and the bag bottom is that the bag top is open at one end so as to be able to receive the filling spigot of a filling machine. Since the top has a double-walled portion at this open area, the bulk material entering the bag through the spigot presses the bottom layer of this zone, known as the valve zone, against the overlapping top layer just before the bag has been completely filled, so that an adequate closure is provided.

In the empty state the bag top and bag bottom are each folded or engaged around their respective longitudinal line of symmetry — hereinafter also called the bending edge of the bag top and the bending edge of the bag bottom respectively — onto the bag body, so that the bag may be stored empty in a very reduced space and without being damaged. The bags are stored by being placed either one upon another or one after another or by being wound around a shaft or the like to form a roll or reel in which the individual bags are held together by two strips and also by frictional engagement. When needed for use they can readily be detached individually from the roll or reel.

The conventional manual procedure of opening the valve and engaging the bags on the filling spigots of filling machines needs substantial labor and is therefore expensive. A number of suggestions have therefore been made to mechanise this operation, particularly since the duration of operational steps in modern filling machines of both the in-line and roundabout kind is so reduced that they cannot be taken advantage of with manual operation, at least in cases in which a single operator has to deal with a number of spigots.

For instance, a process and apparatus of the kind described have been disclosed wherein a stack of bags placed horizontally one above another are raised from below by a lifter to a predetermined level so that the top bag of the stack can be picked up by a pickup head. The same has two laterally extending sliders which can be extended from the center of the bag towards its top and bottom so as to be introduced between the folding gaps which are present in the top and the bottom between the top and the body and between the bottom and the body. When in the raised position, one slider then pivots upwards through 90° so that the bag assumes an L-shaped position, the bag already being some distance away from the top bag of the stack. The upwardly pivoted bag top is then introduced into a claw which engages briefly the body below the head to open the valve. The claw then removes the bag from the apparatus, while the bag bottom disengages from its slider so that the bag portion which is still horizontal drops down freely. The claw then pushes the bag onto the filling spigot, whereafter the claw can be released, that is, disengaged from the bag.

Since the above-described movements of the various elements then have to be performed in the reverse order, an elaborate and complicated control is necessary. Also, this complicated movement pattern means that a corresponding amount of time is taken for the individual cycle, and because of permissible accelerations and delays etc., there is a minimum non-improvable cycle time which has ceased to be adequate for the timings possible with present-day filling machines.

In practical operation, however, this known apparatus has been found to have the very serious disadvantage that as a bag is being picked up, the sliders often fail to engage in the folds, because a bag of this kind is not planar, but is an item for conveyance which is very difficult to handle — at least in this way — and which is wavy or bent in all directions. Since the pickup head sliders must, as it were very briefly, engage linearly below the corresponding portion of the top of the bag and the corresponding portion of the bottom of the bag, difficulties often occur because there is a bend or kink or the like in one of these portions. Also, operating difficulties arise when the bags are not disposed in an extended position and the bottom part of the bag has moved towards the top part or conversely.

To obviate these difficulties, it has been sought to accelerate the working cycle by simplifying the movement pattern and the number of structural elements, control elements and so forth has been reduced. By omitting the above-described sliders it has been sought to obviate the operating difficulties just described.

Accordingly, German Laid-Open Application (Offenlegungsschrift) No. 2,221,039 discloses an apparatus for automatically engaging bags on a filling spigot. The apparatus has a first pneumatic suction device which has suction cups and which raises vertically the top bag of a stack of bags stacked one above another in horizontal orientation; the suction cups of this first pneumatic suction device engage eccentrically the top surface of the body — i.e., eccentrically towards the bag top — so that the bag engaged by the suction cup pivots, when lifted from its horizontal position, into a vertical position.

A second suction device then moves the bag thus raised close to the filling spigot.

SUMMARY OF THE INVENTION

It is an object of this invention to improve the known processes and apparatus of the kind described and to obviate their disadvantages and to provide a process and apparatus providing simple and reliable opening of the valves and engagement of the valved bags on a filling spigot, even though the empty bags which have to be prepared correspondingly are, as a result of manufacture and storage, wavy, kinked, etc. The invention provides not only a very simple handling of the bags, but also an appropriate preparation in a very short time, so as to be able to make full use of the cycle time of the subsequent filling machine. It is another object of the invention to enable a single apparatus to deal with valved bags of different sizes and also to make it possible to be able to process, as required, bags which differ alternately or periodically and bags from different sources of supply.

This object and others to become apparent as the specification progresses, are accomplished by the invention, according to which, briefly stated, the process for opening the valves of valved bags and for inserting the opened bags on spigots to fill the bags with bulk material, comprises the following steps: consecutively advancing the bags in a substantially horizontal plane towards the spigots, while the bag valve is oriented in the advancing direction of the bags and guiding each bag by a free edge of the bag top; pivoting, during the advancing step, the top of each bag about a top fold line from a horizontal orientation, in which it is substantially coplanar with the bag body, into a predetermined inclined position; pivoting, subsequent to the preceding pivoting step, that half of the bag top which is oriented towards the bag body, about the top fold line, into a predetermined inclined position with respect to the bag body, whereby the bag top assumes an inverted V configuration; pivoting, subsequent to the preceding pivoting step, the bag body downwardly into a vertical orientation; raising, subsequent to the preceding pivoting step, at least the valve-containing portion of the bag relative to the bag body for opening the valve while holding the bag body; and inserting, subsequent to the raising step, the bag on the respective spigot.

What is very advantageous about this process is not only that the bags are initially disposed substantially horizontally, guided at their free top edge, as they are advanced consecutively towards the delivery station, but also and more particularly that the bags near the filling machine are advanced towards the delivery station continuously or in the case of stepwise operation, at least quasi-continuously, in contrast to what occurs in the known processes. Consequently, the invention aids considerably in increasing the throughput.

For performing the above-outlined method, the invention provides an apparatus which has a transfer means including a first conveyor for conveying bags disposed individually and consecutively on the conveying run of the first conveyor. The substantially horizontal conveying run of the first conveyor moves towards the filling machine and has at least on one edge portion a guide extending in the conveying direction. The opening mechanism cooperating with the transfer means has first pivoting means adapted to pivot the top of the respective bag from its horizontal position in which it is parallel to the bag body, around the top-bending edge into an inclined position. The transfer means further comprises second pivoting means for pivoting back that half of the bag top which is near the bag body around the top-bending edge towards the bag body against an abutment into an inclined position relative to the bag body. The transfer means also comprises a second conveyor which is disposed after the first conveyor as considered in the conveying direction and which engages the bag tops and on which the bag body is adapted to be pivoted around the top-bending edge from a horizontal position into a vertical position.

In a preferred simplified form of the invention, the transfer means can comprise mechanical guide means which are operative on the underside of the top of a bag to be engaged on the spigot and which rise relatively to the horizontal conveying direction of the transfer means towards the delivery end of the guide means (that is, towards the filling spigot).

BRIEF DESCRIPTION OF THE DRAWINGS

FIG. 1 is a very schematic partial side elevational view, looking in the direction of the arrow I in FIG. 2, of an apparatus according to the invention for opening valved bags and engaging them on a filling spigot;

FIG. 2 is a plan view looking in the direction of arrow II of FIG. 1;

FIG. 3 is a section on the line III—III of FIG. 2;

FIG. 4 is a section on the line IV—IV of FIG. 2;

FIG. 5 is a partial end view of the apparatus of FIGS. 1 and 2, looking in the direction of an arrow V of FIG. 2;

FIG. 6 is a partial view, looking in the direction of an arrow VI of FIG. 2, of a part of the apparatus, such part having been omitted for the sake of clarity from FIGS. 1 and 2, the part serving to separate valved bags from a supply roll or reel and to supply the separated bags correspondingly, in the transverse direction, to that part of the apparatus which is shown in FIGS. 1 and 2;

FIG. 7 is a plan view of the structure shown in FIG. 6;

FIG. 8 is a partial top plan view of a valved bag showing the top and part of the body of the bag when the same is empty;

FIG. 9 is a side elevational view looking in the direction of arrow IX of FIG. 8;

FIG. 10 is a view corresponding to FIG. 9, with the bag top pivoted away from the body;

FIG. 11 is a view similar to FIG. 10 where that part of the top which is near the body has been pivoted from the position it occupied in FIG. 10 at the time;

FIG. 12 is a view similar to FIG. 1 of a variant in which the transfer means have mechanical valve opening means which rise towards the delivery position;

FIG. 13 is a plan view of the structure shown in FIG. 12; and

FIG. 14 is a partial end view of the apparatus shown in FIGS. 12 and 13, the view being from the delivery position.

DESCRIPTION OF THE PREFERRED EMBODIMENTS

FIGS. 1 to 7 of the drawings shown an apparatus for opening valves 1 (see FIGS. 7, 8) of valved bags 2 to be filled with cement and for engaging the opened bags 2 on a filling spigot 3, shown only in FIG. 1, of a filling machine 4, shown schematically in FIG. 1.

The apparatus has an opening device by means of which, as will be described in detail hereinafter, a bag top 6 comprising the valve 1 can be moved from a position parallel to the plane of bag body 7 into a position substantially perpendicular to such plane and the valve 1 can be opened. The apparatus also comprises transfer means, which will be described in detail hereinafter, for transferring the bags 2 towards the filling spigot 3. The transfer means comprise a first conveyor which is a timed belt conveyor 8. Top run 9 thereof is the conveying run and in operation runs horizontally, in the direction indicated by an arrow 11, towards the filling machine 4. A guide 12 which extends in the conveying direction 11 is provided on one edge part of the run 9.

As can be seen in FIGS. 6 and 7 (corresponding components have been omitted from FIGS. 1 and 2 for the sake of clarity), a pressing unit is disposed above the conveyor 8 and is adapted to press onto the top run 9 the bags 2 which have contacted the guide 12 and to engage such bags frictionally with the top run 9, so that the conveyor 8 then conveys the particular bag 2, as will be described hereinafter in detail. The pressing unit comprises a pneumatic reciprocating unit 13 which can be seen in FIGS. 6 and 7 and whose piston rod 14 has a roller 16 at its lower free end. Means such as a slide shoe or the like can be used instead of the roller 16.

The pressing unit comprises three pairs of parallel pressing rollers 17.

The opener of the apparatus has first pivoting means 18 formed as a bar-like or rod-like member or rail or the like. The pivoting means 18, by virtue of an appropriate curvature, can engage the top of the conveyed bag 2 so as to pivot the same from a position shown in FIG. 9 into a position shown in FIG. 10. That is, the bag top is pivoted from a horizontal position, in which the bag top is parallel to the bag body 7, around a bending edge 19 of the bag top (visible in FIG. 10), into an inclined position.

The opener further has second pivoting means 21 formed as a rod-like rail or the like and which, as viewed in the conveying direction 11, begin subsequent to the first pivoting means 18. The second pivoting means 21 are also appropriately curved and are so disposed as to be engageable by that half of the bag top 6 which is near the bag body 7 and which is shown cross-hatched in FIG. 8. As a result, the bag top half can be pivoted back around its bending edge 19 towards the bag body 7 against an abutment 22 into an inclined position (as seen in FIG. 11) relatively to the bag body 7.

A rail-like or bar-like abutment 23 is associated with the first pivoting means 18; both the abutments 22, 23 extend substantially parallel to the respective pivoting means 18, 21 and are spaced from one another at a distance corresponding substantially to the thickness of the bags.

The transfer means also comprise a second conveyor 24, 26 which is disposed after the conveyor 8 as viewed in the conveying direction 11 and which engages the bag top 6 and on which the bag body 7 can be pivoted around the edge 19 of the then substantially V-shaped bag top 6 from a horizontal position into a vertical position. The second conveyor 24, 26 comprises a substantially V-shaped guide 24 and driving means for moving the bags 2 along the guide 24. In the embodiment shown the drive means take the form of grooved rollers 26 adapted in shape to the shape of the guide 24 and driven by way of a belt drive 27 shown in FIG. 1. In the alternative, the drive could be effected, for example, on the bag body 7 or the guide 24 could be movable like a belt conveyor or the like. What is of importance in this connection is that the bag top 6 in its preliminary V-shape is retained in this position and that the bag 2 or its body 7 can pivot, in the region of the second conveyor, from its horizontal position into a vertical position while retaining its top shape.

That free end portion E of the second conveyor which is near the filling machine 4 (FIG. 2) can, according to another feature of the invention, be movable transversely in the direction of an arrow 28 or/and in the direction of an arrow 29 so that a single apparatus which in other respects is disposed fixedly can be used to service three or more filling spigots. Consequently, the apparatus can be adapted for a rational servicing of in-line filling machines and also of roundabout machines. As will be clearly apparent, the corresponding adaptation can be effected readily.

At that end of the belt conveyor 8 which is remote from the filling spigot 3 and near the guide 12, a third conveyor 31 is provided (FIGS. 6 and 7) which runs perpendicularly to the conveyor 8 and which has been omitted from FIGS. 1 to 5 for the sake of simplicity. The third conveyor 31 moves the valve bags 2 to the conveyor 8 forming part of the first conveyor. The bags 2 are advanced in their length 32, with the top 6 at the front end, as considered in conveying direction 32, with the valve 1 at the top and on the left. The third conveyor 31 is supplied with the bags 2 from a bag magazine 33 formed as a roll or reel of a large number of valved bags 2 wound on a shaft or spindle 34. The bags 2 are held together by two strips and by friction, so that when the outside surface of the reel 33 presses on the conveying run of the conveyor 36, the same can remove the bags individually from the reel 33 (FIG. 6). This operation calls for a uniform pressure which is produced by means of a weight 37. After appropriate deflection at a rear roller 38 of the conveyor 36, the force derived from the weight 37 acts upwards, and pivots the conveyor 36 upwards around a front roller 39. Pressing rollers 41 then engage a bag 2 which has been removed from the reel 33 and also deflect the bag to an accelerating belt conveyor 42 which provides further bag separation. From the conveyor 42 the bags 2 are supplied consecutively by pressing rollers 43 which transfer the bags over end to conveyor 8 until the free front edge 44 of the bag 2 contacts the guide 12, whereupon the bag 2 has therefore been correctly located on the conveyor 8 and can thereafter be conveyed in the direction of the arrow 11. One of the advantages of this kind of transverse feeding is that a number of feeders can be provided for selectively supplying e.g. different bags to the conveyor 8.

Instead of or in addition to this feature, bags 2 can of course be supplied to conveyor 8 at the rear thereof. A combination of a supply to the rear of the conveyor 8 and a supply perpendicularly to the conveying direction of conveyor 8 is advantageous more particularly in cases in which, for instance, a single apparatus is to process special cements, different sizes of bags 2, different bags and/or different bulk materials or different qualities of bulk materials.

The apparatus according to the invention hereinbefore described and the process according to the invention operate as follows:

The bags 2 are either just supplied in a horizontal position to the conveyor 8 at the rear (upstream end) thereof and/or, alternatively, are supplied by means of the third conveyor 31 in a direction perpendicularly to the conveying direction 11 of conveyor 8, so that the bags 2 assume a position as seen in FIG. 2 or FIG. 7. In this position the respective bag 2 has aligned itself freely on the guide 12, so that the pressing unit 13 can now operate and the roller 16 can press on the bag 2. Consequently, the same frictionally engages the top run 9 of conveyor 8 and therefore continues to be conveyed thereby in the direction of the arrow 11. The front longitudinal edge 45 of the bag 2 enters into frictional engagement shortly afterwards with pressing rollers 17 which also form part of the pressing unit, while the bag top 6 is still being guided on the guide 12. Since the rollers 17 are arranged in pairs, there are at least two pressing positions or, if the roller 16 is included, there are at least three pressing positions. Consequently, the bag cannot twist in the horizontal plane, more particularly in view of the cooperation with the guide 12. This circumstance is shown very schematically in FIG. 3.

During its subsequent intermittent advance, the bag top 6 is first engaged by the first pivoting means 18, to be pivoted thereby upwardly from the position shown in FIGS. 3 and 9 into the inclined position shown in FIGS. 4 and 10. During this occurrence the means 18 presses on the outside edge part of top 6.

Shortly afterwards that region of the top 6 which is shown cross-hatched in FIG. 8 is engaged by the second pivoting means 21, to be pivoted back against abutment 22 towards the bag body 7, as shown in FIG. 11.

The top 6 has therefore been given a V shape (roof shape) which is maintained by the pivoting means 18 and 21, on the one hand, and the abutments 22 and 23, on the other hand. The bag body 7 still is in a horizontal position.

Upon transfer to the second conveyor, that is, when the bag top 6 deformed as shown in FIG. 11 is pushed onto the V-shaped guide 24, the bag top 6 is engaged by the driven rollers 26 to be advanced thereby in the conveying direction 11 along the guide 24. The body 7, since it is no longer supported, pivots from its horizontal position into a vertical position, as shown in FIG. 5. The end of this phase is shown in the top left-hand part of FIG. 1, where the bag 2 is just about to leave the second conveyor so that its valve 1 may now be conventionally opened. The valve 1 is opened by gripping claws 46 which are shown in only very diagrammatic form in FIG. 1 and which engage the bag 2 by its body 7, and by a forked claw 47 which engages around the top 6 and raises the same to a limited extent in the direction of arrow 48 relatively to claws 46, so that the valve opens automatically. All the claws 46, 47 together form a unit 49 which can be given a timed movement forwards and backwards on a linearly extending rod or bar or the like (not shown in the drawings) towards the filling spigot 3 by means of an appropriate drive so as to engage the bag 2 on a spigot 3.

It is apparent that if the portion E is transversely movable as well, the apparatus can be used to service a number of spigots 3 alternately.

FIGS. 12 and 14 show a variant of an apparatus for opening the valves 1 of valved bags 2 to be filled with cement and for engaging the opened bags 2 on the filling spigot 3 of a filling machine 4.

As in the case of the embodiment of FIGS. 1 to 7, the apparatus has pivoting means for moving the bag top 6 (which contains the valve 1) from a position in which it is parallel to the plane of the bag body 7 into a position in which it is substantially perpendicular to such plane.

The apparatus also has transfer means which serve to convey the bags 2 towards the spigot 3 and which is generally similar to the construction shown in FIGS. 1 to 7.

The variant shown in FIGS. 12 and 14 differs from the embodiment illustrated in FIGS. 1 to 7 mainly in that that horizontal portion of the guide 24 which is covered by the rollers 26 and which has, for example, an inverted V shape, is followed by a portion 24′ which rises relatively to the horizontal conveying direction of the transfer means towards the delivery end of the guide means — i.e. towards the spigot 3 — and ends about one and a half sack lengths before the spigot 3. The portion 24′ comprises another conveyor which cooperates with the bag body 7 and which is a double belt conveyor 26′ in the embodiment shown. The facing conveying runs of the individual endless belts 26′ engage both sides of the body 7. Conveyor 26′ engages the body 7 over the whole length of the portion 24′ and thus prevents the bag from turning around an axis perpendicular to the body 7 when the valve opens.

Since the conveyors 26′ move the bag 7 horizontally towards the spigot 3, while the bag top 6 is in contact with the guide 24 or its portion 24′, the guide 24′ (constituted by a dual rail) automatically applies a force to the underside of the bag top, that is, to the longitudinal edge parts thereof. As a result, the bag top or its two mirror-image halves rise relatively to the body 7, with the further result that the valve 1 opens automatically. The guide 24′ can in practice be of any length and correspondingly convey the bags, for instance, for several meters or more. This may be advantageous, for instance, when there is no space available at the packing or filling machine for the unreeling and separating facilities. Also, if the guide 24′ is of substantial length, it may be deflected horizontally and/or vertically.

It is another advantage of the above arrangement that in the case of an arbitrarily long conveyor 26, an automatic engagment of the valved bags on the spigots is possible even for an intermittent conveyance, since the invention makes no use of reciprocating movements between the location of bag removal and the location of bag engagement.

The resulting cross-sectional shape of the bag top 6 is shown in dash-dotted lines above FIG. 14. In FIG. 14, for the sake of clarity, the top part of the structure has been shifted upwardly. It is to be understood that the folding edge 19 is disposed as indicated by solid lines in FIG. 12.

The top part of FIG. 14 also shows diagrammatically a preferred form of second guide means comprising two spaced-apart angle-members 51 associated with the longitudinal lateral edges 44, 44′ of the bag top 6. As can be seen in FIG. 12, the second guide means 51 are disposed near the delivery position to prevent the opened valve 1 from closing. Consequently, the distance between the bars 51 is substantially equal to the distance between the two side longitudinal edges 44, 44′ of the bag 6 with the valve 1 open.

The apparatus according to the invention shown in FIGS. 12 to 14 operates very similarly to the apparatus described with reference to FIGS. 1 to 7. The main difference is that in the construction in FIGS. 12 to 14 the valve 1 is opened after the shaping of the bag top 6 into an inverted V and after the pivoting of the bag body 7 from its original horizontal position into a vertical position by means of the stationary mechanical guide when the bag body 7 is engaged by the belt conveyors 26' and advanced further in the conveying direction and horizontally towards the delivery station. Simultaneously with this occurrence (or shortly prior or subsequent thereto) the bag top 6 runs on to the rising portion 24' of the fixed guide which applies a force to the underside of the bag 6 at least in the region of the two longitudinal edge portions 44, 44'. This causes opening of the valve 1 automatically, maintaining the valve open reliably, since once the valve has opened, the bag top enters the second guide 51 in which it cannot possibly reclose.

The bag 2 is removed at the delivery station and engaged by a known device (omitted from the drawings for the sake of simplicity) to be inserted on the filling spigot 3. Such an insertion occurs directly in case of an in-line filling machine — possibly after a lateral parallel movement of the bag 2 — and after pivoting the bag through 90° in case of a roundabout machine. The latter apparatus can have means for compressing the longitudinal edges of the bag top laterally, by means of which the valve can be re-opened should it have partly reclosed upon or after removal from the delivery station of the guide.

The above-noted re-opening of the valve before engagement on the spigot is in any case no problem at all, since a valve which has been opened after being stored re-opens readily, particularly, when assisted by the own weight of the hanging bag. This weight also ensures that any appreciable closure of the valve after removal from the delivery station is highly unlikely.

The particular advantage of the apparatus structured according to the invention is that it is relatively simple and rugged and therefore very reliable in operation. More particularly, however, the apparatus according to the invention is completely unaffected by crumpled, creased, kinked or otherwise irregular bags. There may even be creases in the body because of relative movements between the top and the bottom; this circumstance, however, will not impair operation at all, because, for example, no sliders have to be introduced abruptly into a folding gap to a relatively long linear extent. Instead, the pivoting means according to the invention engage the bag top in a point-like manner and prepare the whole top region correspondingly only during the advance. Another reason for these very considerable advantages is that the bags are handled only at one end — i.e., at the top — and the bottom and the body of the bag can take up any position within the appropriate limits since they do not have any definite engagement with any components of the apparatus but just rest as separate items on the conveyor. It is another considerable advantage that the apparatus according to the invention can be used for bags of very different sizes and that bag feeding can be effected selectively in the conveying direction or transversely thereto or alternately in both such directions. Consequently, the apparatus according to the invention is highly versatile, more particularly since it may be used very satisfactorily not only in conjunction with an in-line filling machine but also with a roundabout or circular filling machine.

We claim:

1. A process for opening the valves of valved bags each having a bag top and a bag body and for inserting the opened bags on spigots to fill the bags with bulk material, comprising the following steps:

(a) consecutively advancing the bags in a substantially horizontal plane towards the spigots, while the bag valve is oriented in the advancing direction of the bags; said advancing step includes guiding each bag by a free edge of the bag top;

(b) pivoting, during the advancing step, the top of each bag from a horizontal orientation, in which it is substantially coplanar with the bag body into a predetermined inclined position about a top fold line;

(c) pivoting, subsequent to step (b), that half of the bag top which is oriented towards the bag body, about said top fold line, back into a predetermined inclined position with respect to the bag body, whereby the bag top assumes configuration of an inverted V;

(d) pivoting, subsequent to step (c), the bag body downwardly into a vertical orientation;

(e) raising, subsequent to step (d), at least the valve-containing portion of the bag relative to the bag body for opening the valve while holding the bag body; and (f) inserting the bag on the respective spigot.

2. A process as defined in claim 1, wherein the pivoting step defined in (b) is started at a side end of the bag top and is continued progressively along the length of the bag top.

3. A process as defined in claim 1, wherein the pivoting step defined in (c) is started at a side end of the bag top and is continued progressively along the length of the bag top.

4. In an apparatus for opening the valves of valved bags each having a bag top containing the valve and a bag body and for inserting the opened bags on spigots of a filling machine to fill the bags with bulk material, the improvement comprising:

(a) a first conveyor having a substantially horizontal conveying run for consecutively and individually advancing the bags in a horizontal orientation in a conveying direction towards the spigots;

(b) a guide arranged along said conveying run to guide the bag top along an edge thereof;

(c) a first pivoting means arranged in the zone of said first conveyor for pivoting each bag top, while the bag is advanced on said conveying run, from a horizontal position in which it is parallel to the bag body, into a position in which it is inclined to the bag body;

(d) a second pivoting means, including an abutment, said second pivoting means being arranged in the zone of said first conveyor and downstream of said first pivoting means for pivoting that half of the bag top which is adjacent to the bag body into a position in which it is inclined with respect to the bag body and the other half of the bag top; and (e) a second conveyor arranged downstream of said first conveyor for receiving the bags therefrom and further advancing them towards the spigots; said second conveyor including means for supporting the bag by the bag top and effecting a downward pivotal motion of the bag body from its horizontal position into a vertical position.

5. An apparatus as defined in claim 4, wherein said first conveyor is a timed continuous conveyor.

6. An apparatus as defined in claim 4, wherein said first conveyor is a belt conveyor.

7. An apparatus as defined in claim 4, further comprising at least one pressing unit arranged above said first conveyor for pressing the bags into frictional engagement with said conveying run of said first conveyor.

8. An apparatus as defined in claim 7, wherein said pressing unit includes reciprocating means and a pressing member attached to said reciprocating means for moving said pressing member into engagement with said conveying run of said first conveyor.

9. An apparatus as defined in claim 7, wherein said pressing unit comprises at least one pair of guide rollers for maintaining the bags in operative engagement with said guide during their conveyance by said first conveyor.

10. An apparatus as defined in claim 4, wherein said first pivoting means comprises a guide bar for engaging a free edge zone of each bag top.

11. An apparatus as defined in claim 4, wherein said second pivoting means comprises a guide bar for engaging each bag top at a location close to the bag body.

12. An apparatus as defined in claim 4, wherein said first pivoting means comprises a first guide bar for engaging a free edge zone of each bag top and a first abutting member and wherein said second pivoting means comprises a second guide bar for engaging each bag top at a location close to the bag body and a second abutting member; said first and second abutting members being substantially parallel to the respective first and second guide bars being spaced therefrom at a distance substantially corresponding to a bag thickness.

13. An apparatus as defined in claim 4, wherein said second conveyor comprises a substantially V-shaped guiding member for guiding each bag top and driving means for moving the bags along said V-shaped guiding member.

14. An apparatus as defined in claim 4, wherein at least one length portion of said second conveyor is arranged for displacements transverse to the conveying direction; said length portion being adjacent the filling machine.

15. An apparatus as defined in claim 4, further comprising a third conveyor disposed perpendicularly to said first conveyor at an upstream end thereof for individually and consecutively supplying and transferring the bags to said first conveyor.

16. An apparatus as defined in claim 15, further comprising a bag roll support means arranged above said third conveyor for holding a supply of bags wound to constitute a bag roll.

17. An apparatus as defined in claim 16, wherein said third conveyor includes a belt conveyor having a conveying run; the improvement further comprising force-exerting means urging said conveying run of said third conveyor in the direction of said bag roll support means into contact with the outer end of the bag roll.

18. An apparatus as defined in claim 17, wherein said force-exerting means includes a weight, a cable having a first end to which said weight is attached and a second end operatively connected to said conveying run of said third conveyor and pulleys supporting said cable.

19. An apparatus as defined in claim 4, further comprising means for compressing each bag top laterally prior to engagement thereof on the respective spigot.

20. An apparatus as defined in claim 4, further comprising a guide arrangement situated downstream of said second conveyor for cooperating with an underside of each bag top; said guide arrangement sloping upwardly in the direction of bag feed for raising the bag top to the respective spigot relative to the bag body.

21. An apparatus as defined in claim 20, wherein said guide arrangement comprises at least one bar.

22. An apparatus as defined in claim 20, wherein said guide arrangement comprises two horizontally spaced bars cooperating with the underside of each bag top on either side of the respective bag body.

23. An apparatus as defined in claim 22, wherein said bars diverge from one another in the upward direction and define between themselves an elongated slot for accommodating the bag body.

24. An apparatus as defined in claim 20, wherein said guide arrangement has, at the downstream end thereof which is adjacent the respective spigot, a guide component for cooperating with longitudinally extending side edges of the bag top.

25. An apparatus as defined in claim 24, wherein said guide component comprises two bars between which the bag top moves with the valve opened, the distance between said two bars of said guide component being substantially equal to the distance between longitudinal side edges of the bag top with the bag valve open.

26. An apparatus as defined in claim 20, wherein said guide arrangement extends along a relatively large length portion of said second conveyor.

27. An apparatus as defined in claim 26, wherein said guide arrangement changes orientation into the horizontal direction.

28. An apparatus as defined in claim 26, wherein said guide arrangement changes orientation into the vertical direction.

29. An apparatus as defined in claim 20, further comprising a bag feeding arrangement situated underneath said guide arrangement for advancing the bags by engaging the respective bag body.

30. An apparatus as defined in claim 29, wherein said bag feeding arrangement terminates at least one bag length upstream of the respective spigot of the filling machine.

31. An apparatus as defined in claim 29, wherein parts of said bag feeding arrangement that engage the bag body extend substantially along the entire length of said guide arrangement.

32. An apparatus as defined in claim 29, wherein said bag feeding arrangement comprises at least two face-to-face oriented cooperating conveying runs between and by which the bag bodies are advanced.

33. An apparatus as defined in claim 32, wherein said conveying runs of said bag feeding arrangement are urged into engagement with one another.

34. An apparatus as defined in claim 32, wherein said conveying runs of said bag feeding arrangement are constituted by driven belts.

35. An apparatus as defined in claim 32, wherein said cooperating conveying runs of said bag feeding arrangement together define a substantially vertically oriented plane.

36. An apparatus as defined in claim 32, wherein said cooperating conveying runs of said bag feeding arrangement together define a substantially horizontally oriented plane.

* * * * *